United States Patent [19]

Selwyn-Smith

[11] Patent Number: 4,856,660

[45] Date of Patent: Aug. 15, 1989

[54] DOCUMENT SUSPENSION APPARATUS

[75] Inventor: Clive Selwyn-Smith, Weston-on-the-Green, England

[73] Assignee: Locwyn Limited, England

[21] Appl. No.: 106,597

[22] Filed: Oct. 13, 1987

[51] Int. Cl.[4] ..... A47F 7/16

[52] U.S. Cl. ..... 211/46; 402/4

[58] Field of Search ..... 211/46, 45, 47, 48, 211/94, 162; 312/134, 183, 184; 493/947; 402/4; 281/35, 15 A

[56] References Cited

U.S. PATENT DOCUMENTS

| | | | |
|---|---|---|---|
| 2,174,201 | 9/1939 | Chauvin | 211/46 |
| 2,750,142 | 6/1956 | McKee | 248/224.1 X |
| 3,885,726 | 5/1975 | Fridlund | 281/15 A X |
| 4,157,875 | 6/1979 | Smith | 402/4 |
| 4,420,086 | 12/1983 | Bardes | 312/184 X |
| 4,674,637 | 6/1987 | Lovelock | 211/46 |

FOREIGN PATENT DOCUMENTS

| | | |
|---|---|---|
| 0056685 | 7/1982 | European Pat. Off. . |
| 544687 | 2/1932 | Fed. Rep. of Germany . |
| 2266605 | 10/1975 | France . |
| 1182051 | 2/1970 | United Kingdom . |
| 2150118 | 6/1985 | United Kingdom . |

*Primary Examiner*—J. Franklin Foss

*Attorney, Agent, or Firm*—Oliff & Berridge

[57] ABSTRACT

Document suspension apparatus comprising a rail member (1) arranged to be suspended from a fixed suspension means, such rail member having welded thereto a plurality of different sized document containers (3, 4) to allow different sized documents to be suspended from the same rail member (1).

7 Claims, 1 Drawing Sheet

DOCUMENT SUSPENSION APPARATUS

DESCRIPTION

Figure 1:
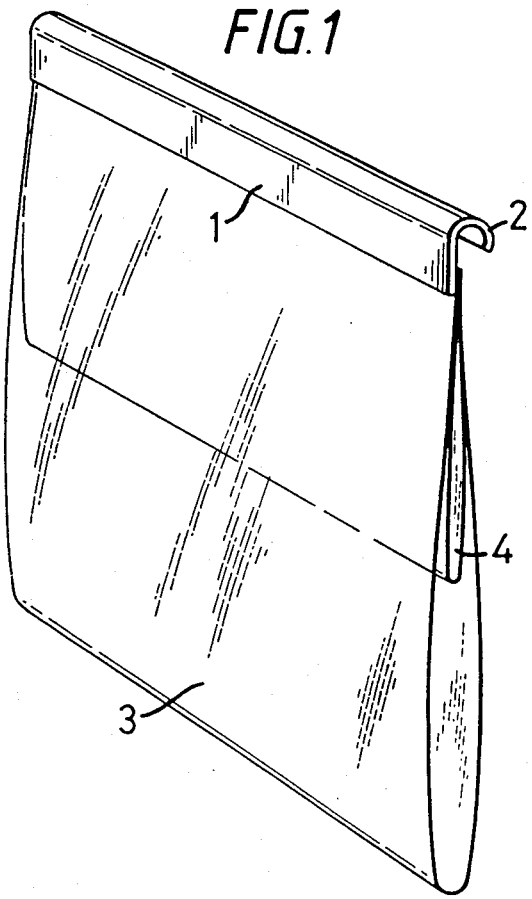

This invention relates to document suspension apparatus. In particular the invention relates to document suspension apparatus which may be suspended from the rails, rods or the like of a document filing system such as that described in U.S. Pat. No. 4,674,637.

It is desirable to provide within a document filing system, apparatus which is capable of supporting and providing storage for documents of different sizes. For instance, a requirement to store both A4 and A3 sized documents in the same document filing system, may arise. Conventionally, storage pockets of differing sizes have been used to accommodate different sized documents within the same filing system.

In order to maximise the use of the space available in a larger document filing system, document suspension apparatus, for mounting within the document filing system, comprising a sleeve suspended below a rail, the sleeves having its sides welded together along a line parallel to the rail so as to provide two pouches, one above the weld line and one below the weld line, has been employed. This type of document suspension apparatus has proven unsatisfactory in use, because documents within the upper pouch rest on the weld line and tend to cause the sleeve to tear at this weak point.

Other solutions to the problem of storing different sized documents have been proposed.

A folder is described in published European Patent Application No. 0056685, which folder comprises a plurality of small pockets secured to a larger pocket, which in turn hangs from two supporting rails. This folder is complex, bulky and expensive to manufacture. The folder is held together by a larger number of seams, many of which are put under direct load when the folder is in use.

A hanging pocket is described in British Patent Application No. 2013575, which pocket comprises a sleeve dependent from a supporting rail. The sleeve has a plurality of slots cut into it to allow the insertion of documents. The documents are stored with their lower edges resting in the sleeve and their upper parts outside the sleeve. The slots are cut at different levels to allow the storage of documents of different sizes. However, since the documents remain partially exposed outside the pocket, they are unprotected from any external damaging or soiling influences.

Many of the disadvantages of the aforementioned devices are overcome by the present invention which provides document suspension apparatus comprising a rail member, arranged to be suspended from fixed suspension means and document containing means secured to said rail member so as to be dependent therefrom; wherein said document containing means comprises at least one smaller sleeve member secured within a larger sleeve member, and arranged such that documents may be inserted into said sleeve members from a direction substantially parallel to said rail member.

An advantage of the present invention is that documents of different sizes may be suspended and fully supported therein, without the need for a document to rest directly on and in contact with any seam or weld, thereby avoiding the attendant disadvantages of the latter situation. Furthermore, the documents are fully protected from external influences. Document suspension apparatus in accordance with the present invention, is simple to construct, not bulky and is smooth sided. This latter characteristic allows the easy insertion and removal of the document suspension apparatus into and out of a document filing system.

In an embodiment, at least one smaller sleeve member and the larger sleeve member are secured directly to the rail. Whereas in an alternative embodiment, at least one smaller sleeve member is secured to the larger sleeve member, which in turn is secured to the rail member and, in use, the location or locations where the smaller sleeve member is secured to the larger sleeve member, is not in the vicinity of the lower edge of any document located within said smaller sleeve member.

In a further embodiment the sleeves are secured directly to the rail at the same location or locations on the rail. Preferably the sleeves are secured to the rail by a weld extending lengthwise of the rail.

In a preferred embodiment the sleeves are formed from sheets of plastics material, exemplified by polypropylene, which sheets are secured by welding to the rail. An advantage of all these further and preferred embodiments, is that the document suspension apparatus may be assembled by a single welding operation, in which the sleeves are secured together and to the rail.

For the avoidance of doubt, wherever the term document has been used in this specification, it should be taken to mean any paper, card, photography, or like foliate article, or a plurality of such foliate articles.

Figure 2:
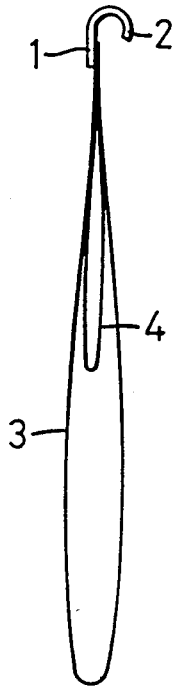

This invention will now be described by way of example only with particular reference to the accompanying drawings wherein:

FIG. 1 is a perspective view of a document suspension apparatus in accordance with the present invention; and FIG. 2 is a side view of the document suspension apparatus shown in FIG. 1.

Referring to FIG. 1, the suspension apparatus comprises a substantially rigid rail member 1 of plastics material provided with a folded portion 2 extending throughout its length. The folded portion 2 allows the member 1 to be suspended from the rods, rails or the like of a document filing system constructed as described in U.S. Pat. No. 4,674,637. Welded, or otherwise secured to the rail member 1 is a sleeve or loop 3 of flexible plastics material. The sleeve 3 is preferably transparent and dimensioned to allow large documents of, for instance, A1 size to be located therein. Within the sleeve 3 is located a smaller sleeve 4 of, for instance, A2 size to accommodate smaller documents. Accordingly, large drawings may be housed within the sleeve 3 and smaller boards or documents within the sleeve 4.

Instead of welding or securing all the sleeves to the rail member 1, one of the sleeves, for example larger sleeve 3 may be so secured and smaller sleeve 4 may be welded or otherwise secured to the larger sleeve 3.

The welds securing the sleeves 3 and 4 together or to the rail member 1 may extend lengthwise of the rail for a majority of the length of each sleeve 3 or 4.

We claim:

1. Document suspension apparatus comprising:

a rail member arranged to be suspended from fixed suspension means; and document containing means secured to said rail member so as to be dependent therefrom;

wherein said document containing means comprises at least one smaller sleeve member within a larger sleeve member, both of said sleeve members being secured to the rail for providing support to documents inserted therein, the arrangement being such that documents may be inserted into said sleeve members from a direction substantially parallel to said rail member, and supported below the rail member, within said sleeve members by said sleeve members alone.

2. Document suspension apparatus as claimed in claim 1, wherein said at least one smaller sleeve member and said larger sleeve member are secured directly to said rail member.

3. Document suspension apparatus as claimed in claim 1, wherein said at least one smaller sleeve member is secured to said larger sleeve member, said larger sleeve member is, in turn, secured to said rail member; the arrangement being such that the location or locations where said smaller sleeve member is secured to said larger sleeve member, is in the vicinity of the rail member, and is not in the vicinity of the lower edge of any document located within said smaller sleeve member.

4. Document suspension apparatus as claimed in claim 2 wherein both said larger and smaller sleeve members are secured to said rail member at the same location or locations.

5. Document suspension apparatus as claimed in claim 4 wherein said sleeve members are formed from a sheet of plastics material, secured by welding to said rail member.

6. Document suspension apparatus as claimed in claim 5 wherein said sleeve members are secured to said rail member by a weld extending lengthwise or said rail member.

7. Document suspension apparatus as claimed in claim 1 wherein said sleeve members are formed from polypropylene.

* * * * *